United States Patent [19]

Munson et al.

[11] Patent Number: 4,994,817

[45] Date of Patent: Feb. 19, 1991

[54] ANNULAR SLOT ANTENNA

[75] Inventors: Robert E. Munson, Boulder; Michel W. Schnetzer, Longmont, both of Colo.

[73] Assignee: Ball Corporation, Muncie, Ind.

[21] Appl. No.: 383,785

[22] Filed: Jul. 24, 1989

[51] Int. Cl.[5] ..... H01Q 13/100; H01Q 13/120

[52] U.S. Cl. ..... 343/770; 343/746; 343/769

[58] Field of Search ..... 343/767, 769, 770, 746, 343/771, 789, 824, 843, 857, 700 MS

[56] References Cited

U.S. PATENT DOCUMENTS

| | | | |
|---|---|---|---|
| 2,791,769 | 5/1957 | Lindenblad | 343/770 |
| 2,834,959 | 5/1958 | Dorne | 343/769 |
| 2,838,754 | 6/1958 | Bickmore | 343/769 |
| 4,208,660 | 6/1980 | McOwen, Jr. | 343/769 |
| 4,242,685 | 12/1980 | Sanford | 343/770 |
| 4,320,402 | 3/1982 | Bowen | 343/700 MS |
| 4,684,953 | 8/1987 | Hall | 343/725 |
| 4,803,494 | 2/1989 | Norris et al. | 343/770 |
| 4,819,003 | 4/1989 | Goto et al. | 343/771 |
| 4,821,040 | 4/1989 | Johnson et al. | 343/700 MS |

*Primary Examiner*—Rolf Hille
*Assistant Examiner*—Peter Toby Brown
*Attorney, Agent, or Firm*—Gilbert E. Alberding

[57] ABSTRACT

An inexpensive, efficient, broadband, slot-type antenna with unidirectional sensitivity includes a slot-forming means defining a plurality of substantially concentric and generally coplanar annular slots and a non-resonant antenna connection means for transmitting electromagnetic energy to and from the plurality of annular slots. The antenna connection means forms a plurality of non-resonant, radially-extending cavities that are adapted to combine electromagnetic energy received at the plurality of concentric, annular slots substantially in phase and to divide electromagnetic energy between the plurality of concentric, annular slots for transmission from the slots generally in phase and along the central slot axis that lies perpendicular to the two concentric, annular, coplanar slots. The antenna may also include a plurality of polarizing antenna elements carried by the slot-forming means adjacent at least one or two of the substantially concentric, annular slots to enhance the unidirectional sensitivity of the antenna. Such a plurality of polarizers may be carried by the slot-forming means in a plurality of locations spaced above and over at least one or two of the concentric annular slots and oriented and distributed around their peripheries at locations to correct for variations to polarity and to suppress cross-polarization to and from the antenna.

54 Claims, 6 Drawing Sheets

ANNULAR SLOT ANTENNA

TECHNICAL FIELD

This invention relates to an annular slot antenna and, more particularly, to a directional, annular slot antenna with broad bandwidth and high gain using a corporate feed and adaptable for circular polarization.

BACKGROUND ART

Slot array antennas have been disclosed in a number of prior patents. U.S. Pat. No. 2,433,924, for example, discloses an antenna adapted to provide non-directional radiation in a horizontal plane.

U.S. Pat. No. 2,570,824 discloses a slot antenna intended to be flat for airborne use and have a band width of several percent through the provision of a plurality of slots fed by a resonant cavity. U.S Pat. No. 2,589,664 also discloses a wide band airborne antenna having a plurality of slots and designed to be incorporated into an aircraft without protruding surfaces. Thus, a structural member of the aircraft, such as a vertical stabilizer, is provided with slots on opposite sides of the stabilizer, covered with dielectric material, and fed from a single T-shaped cavity so that the radiated patterns of each of the slots are in phase in the fore and aft directions of the aircraft and radiate horizontally polarized energy.

U.S. Pat. No. 2,628,311 discloses a broadband, multiple-slot antenna system having a plurality of slots spaced apart by a distance that is small with respect to the wavelength and fed by resonant chambers to provide a substantially uniform current distribution over the outer surface of the antenna structure. The multi-slot antenna can be either a planar or cylindrical array of slots.

U.S. Pat. No. 2,981,949 discloses an antenna intended primarily for airborne application provided with a plurality of center-fed, radially expanding, waveguide portions to project energy radially outwardly from the center so that tee energy may leak through annular slots in the walls of each of the radially expanding waveguide sections to provide an omnidirectional or toroidal beam expanding in the horizontal direction. By progressively feeding adjacent sectoral waveguides, a sectoral beam may be created and swept or scanned about in the horizontal plane about the vertical axis of the antenna.

U.S. Pat. No. 4,647,940 discloses a parallel waveguide, microwave antenna that may be inexpensively manufactured and reliably used even though exposed to the elements. The antenna is comprised of a pair of plates of dielectric material, preferably glass, spaced apart and separated by air, inert gas or vacuum, preferably air, with one of the plates having a metallized surface to provide a ground plane and the other plate having a metallized surface defining a series of waveguide slots or apertures arranged and configured to provide a radiated beam having desired polarization beam, with beam characteristics and parameters as desired. The metallized portions of the two plates are arranged to face each other and define the enclosed air space, and the two plates hermetically are sealed at the edges and fed by a central coaxial cable so that energy introduced to the antenna structure from the central waveguide propagates outwardly in the enclosed air dielectric as expanding circles and escapes to free space by radiation at the plurality of slots or apertures.

U.S. Pat. No. 4,633,262 discloses a TV receive-only antenna of the type disclosed in U.S. Pat. No. 4,647,940 that may be inexpensively manufactured and reliably used outdoors. The TV receive-only antenna is comprised of a first glass plate having a metallized surface and a second glass plate having a metallized circuit pattern designed to receive a planar wave as, for example, from a geostationary equatorial satellite. The glass plates are arranged with their metallized surfaces facing each other and spaced from each other to define an air space between the circuit pattern and ground plane and sealed at the edge to protect the metallized surfaces from the environment.

U.S. Pat. No. 4,825,221 discloses a dielectric transmission line for transmitting electromagnetic waves radiated from one end portion thereof into surrounding space by providing an end portion of the dielectric line contoured to a configuration required for emitting electromagnetic waves in the form of predetermined wave front. In accordance with this patent, the dielectric line may have a plurality of end configurations, including a convex face, a concave face, a conical end, and a flat end; and the end portion of the dielectric line may be provided with varying dielectric constants to shape the wave emitted from the end of the dielectric.

Notwithstanding the prior development efforts represented by the patents above, a need still exists for an efficient, broadband antenna with unidirectional sensitivity, especially an antenna having a single-feed means, that may be inexpensively manufactured and adapted to receive communications from satellite transponders.

DISCLOSURE OF INVENTION

This invention provides an inexpensive, efficient, broadband, slot-type antenna with unidirectional sensitivity. In the antenna, a slot-forming means defines a plurality of substantially concentric and generally coplanar annular slots; and a non-resonant antenna connection means, or antenna feed means, transmits electromagnetic energy to and from the plurality of annular slots. The antenna feed means can have a "corporate feed" form. The antenna connection means forms a plurality of non-resonant radial-extending cavities that are adapted to combine electromagnetic energy received at the plurality of concentric, annular slots substantially in phase and to divide electromagnetic energy between the plurality of concentric, annular slots for transmission from the slots generally in phase and along the central slot axis that lies perpendicular to the plurality of concentric, annular slots. The cavity-forming means of the antenna connection means interconnects the plurality of annular slots with a connector for electromagnetic energy.

In preferred embodiments of the antenna of this invention, a plurality of polarizing antenna elements is carried by the slot-forming means adjacent at least one or two of the substantially concentric, annular slots to enhance uniformity of polarization and the unidirectional sensitivity of the antenna. Such a plurality of polarizers may be carried by the slot-forming means in a plurality of locations spaced above and over at least one or more of the concentric annular slots and distributed around their peripheries at locations to suppress cross polarization to and from the antenna. Such antenna elements may be a plurality of short elongated conductors having lengths less than about one-half wavelength of the center frequency of operation of the antenna and carried over the one or more slots at a distance less than about one-quarter of the wavelength of the center frequency of operation of the antenna. To provide consistent polarization of the electromagnetic energy at the slots, the polarizers may cross the slots at an acute angle. The antenna and antenna connection means may be adapted to send and receive electromagnetic radiation with circular polarization.

BEST MODE FOR CARRYING OUT THE INVENTION

Figure 1:
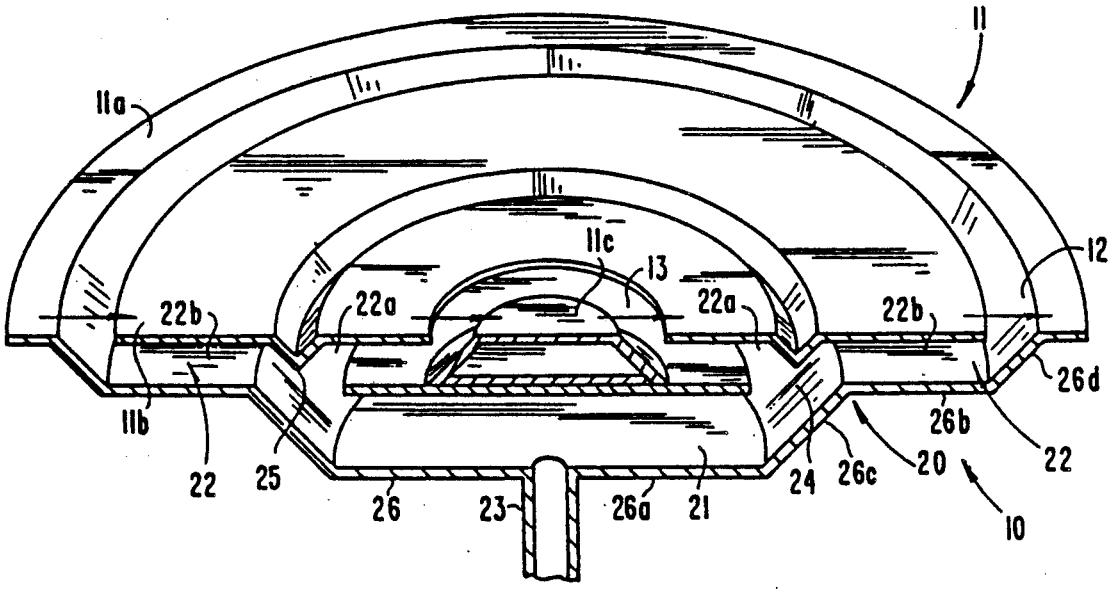
FIG. 1 is a perspective view of an antenna of this invention broken away to show a cross section at a plane through the geometric center of the antenna.

FIG. 1 illustrates a simple embodiment of an antenna 10 of this invention. As shown in FIG. 1, the antenna of this invention includes a slot-forming means 11, defining a plurality (e.g., two) of concentric, generally coplanar, annular slots 12, 13. The width of slots 12, 13 is not critical and is generally less than one-quarter of the wavelength of the frequency at the center of the operating band width of the antenna. The slot-forming means comprising portions 11*a*, 11*b*, and 11*c* is generally coplanar, although it is not necessary that portions 11*a*, 11*b*, and 11*c* lie in exactly the same plane. The radial distance between the concentric annular slots 12 and 13 in the embodiment of FIG. 1 equals the width of portion 11*b* of slot-forming means 11. Preferably, the radial distance between slots 12 and 13 is between one-half wavelength and one wavelength of the frequency at the center of the bandwidth of operating frequencies of antenna 10 to suppress grating lobes. The maximum distance "d" between slots for grating lobe suppression is given by the formula:

$$d = \frac{1 - \frac{1}{2n}}{1 + \sin\theta} \cdot \lambda$$

where n = the number of slots;

$\theta$ = the beam angle from broadside; and $\lambda$ = wavelength at desired frequency.

For example, for a four-slot antenna with the beam steered to broadside (i.e., $\theta = 0$), $$d = \frac{1 - \frac{1}{8}}{1 + 0} \lambda$$

or 0.875 wavelengths. Larger spacings should not affect the impedence match of the antenna; however, grating lobes will occur in the radiation pattern near the horizon. Hereafter, where reference is made to wavelengths and frequencies, it is to be understood that such a reference is to the frequency at the center of the operating bandwidth of the antennas of this invention. It should be noted that antennas of the invention have effective bandwidths on the order of one octave or more.

Antenna 10 also includes an antenna connection means 20 for transmitting electromagnetic energy to and from the plurality of concentric, annular slots. As shown in FIG. 1, connection means 20 defines a plurality of non-resonant radially extending cavities 21 and 22 that are adapted to combine electromagnetic energy received from concentric, annular slots 12 and 13 and to divide electromagnetic energy supplied to antenna 10 by connection means 23 between concentric, annular slots 12 and 13. As shown and described, antenna connection means 20 is adapted to combine electromagnetic energy from slots 12 and 13 generally in phase for reception by connection means 23 and divides electromagnetic energy provided from connections means 23 so that it is propagated in phase, as indicated in FIG. 1. Such antenna feed means as are shown in FIGS. 1 (and in FIGS. 1A and 3) have a form that may be referred to as a "corporate feed".

Thus, antenna connection means 20 provides a non-resonant cavity-forming means interconnecting slots 12 and 13 with connection 23. As shown in FIG. 1, antenna connections means 20 forms a lower, circular cavity 21 extending radially from connection 23 to a peripheral annular opening 24 An upper cavity 22 is annular and expands radially outwardly from a peripheral, annular opening 24 to terminate at outer annular slot 12. Upper annular cavity 22 also contracts radially inward from the peripheral, annular opening 24 and terminates at innermost annular slot 13 as shown in FIG. 1. An annular power divider 25 may be carried by slot-forming means 11 (see portion 11*b* of slot-forming means 11) within upper annular cavity 22 adjacent peripheral, annular opening 24 between upper annular cavity 22 and lower circular cavity 21.

Figure 1A:
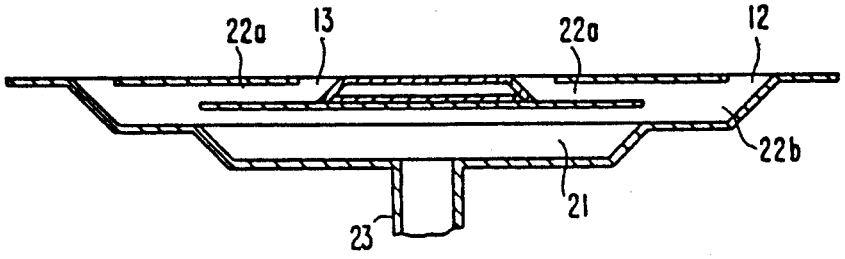
FIG. 1A is a cross-sectional view of another embodiment of the antenna of FIG. 1.

In the embodiment of FIG. 1, the height of the lower cavity is about one-half wavelength; and the height of the upper cavity is about one-quarter wavelength. It should be noted, however, that the height of an inner, annular cavity portion 22*a* and the height of an outer annular cavity portion 22*b* may be different as shown in FIG. 1A. For example, by making the height of the inner annular cavity portion 22*a* between peripheral, annular opening 24 and innermost annular slot 13 less than the height of outer cavity portion 22*b* between the peripheral annular opening 24 and outer annular slot 12, as is shown in FIG. 1A, the electromagnetic energy may be divided by the antenna connection means to provide a uniform power density both around the periphery of innermost slot 13 and around the longer periphery of outermost annular slot 12.

Figure 3:
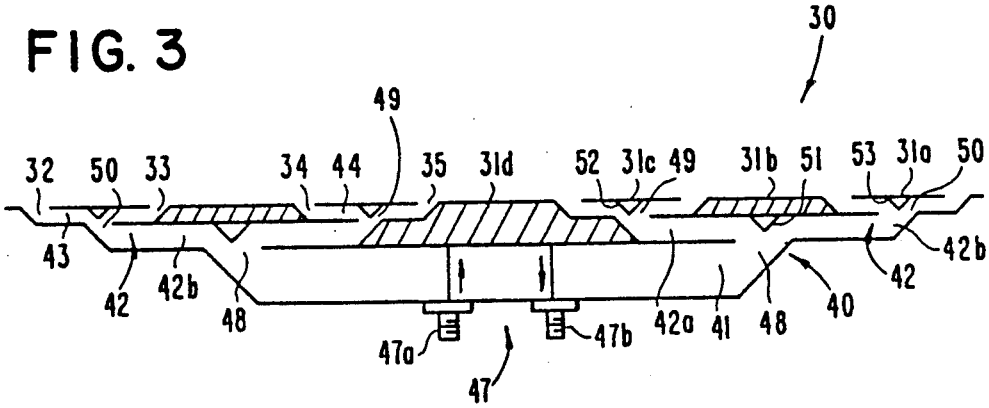
FIG. 3 is a cross sectional view of the antenna of FIG. 2 at a plane through the geometric center or axis of rotation of the antenna.

It should be understood that connection means 23 may be any connection means known in the art; for example, connection means 23 may be a waveguide that opens into lower cavity 21, preferably coaxially at the center of antenna 10 as shown in FIG. 1. Connection means 23 may be, as shown in FIG. 3, a plurality of phased stub feeders located centrally in antenna connection means 20. Connection means 23 may be and is preferably, adapted to transmit and receive an electromagnetic energy with circular polarization. The antenna connection means 20 of antenna 10 is also preferably operated in the TEM mode.

Figure 2:
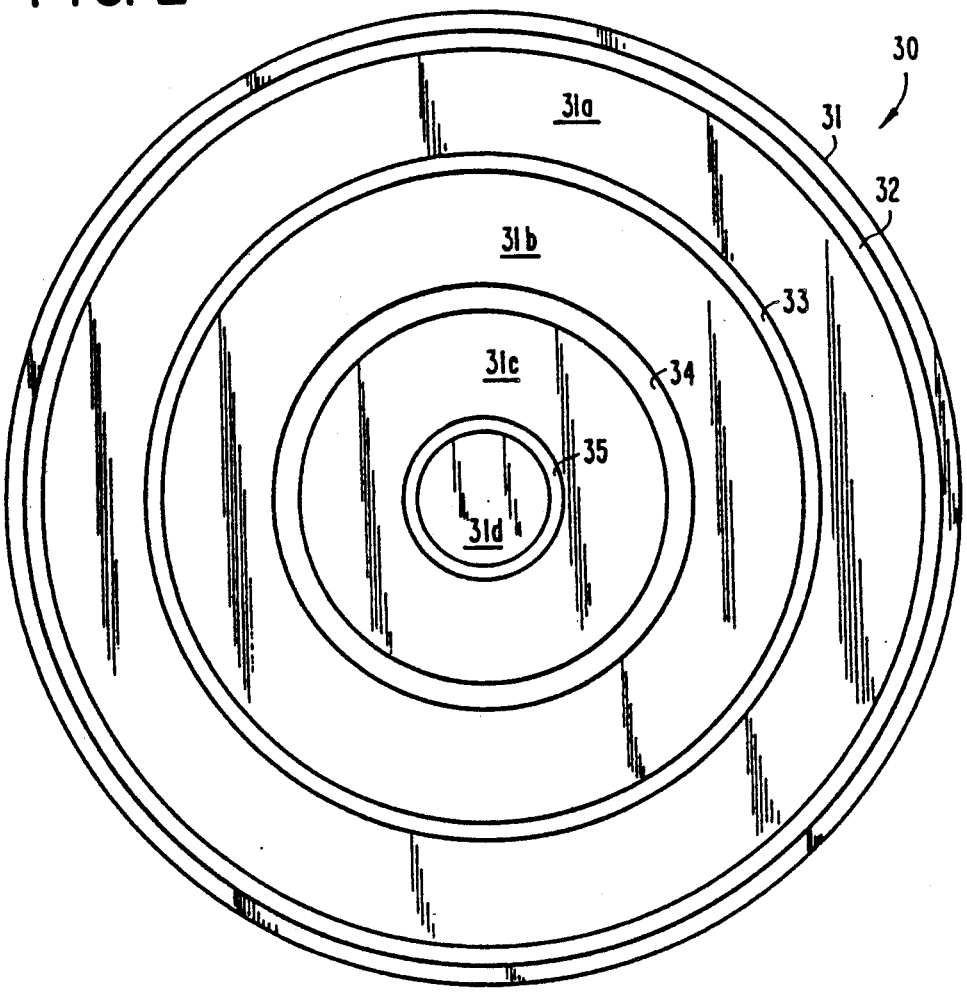
FIG. 2 is a upper plane view of another antenna of this invention.

FIGS. 2 and 3 show another embodiment 30 of an antenna of this invention. Antenna 30 of FIGS. 2 and 3 provides slot-forming means 31 that defines four slots 32, 33, 34, and 35. In the embodiment of FIGS. 2 and 3, each of slots 32–35 can be separated from the adjacent slot by a radial distance calculated as set forth above. As shown in FIGS. 2 and 3, for example each of the sections 31*a*, 31*b*, and 31*c* has a radial width equal to about one-half wavelength; and the diameter of portion 31*d* of slot-forming means 31 is equal to about one-half wavelength.

An antenna connection means 40 of antenna 30 defines a plurality of cavities 41, 42, 43, and 44. Each of the cavities 41–44 extends radially within the antenna connection means and is adapted to combine electromagnetic energy received at the plurality of concentric annular slots substantially in phase within the antenna connection means and to divide outgoing electromagnetic energy between the plurality of annular slots in such a manner that it is propagated from the plurality of annular slots generally in phase along the central axis perpendicular to the plane of the plurality of annular slots.

As shown in FIG. 3, the plurality of radially extending cavities includes a lower circular cavity 41 extending radially from connection means 47 and terminating in a peripheral, annular opening 48 which communicates with annular cavity 42. As shown in FIG. 3, annular cavity 42 includes an inner, annular cavity portion 42*a* extending from peripheral, annular opening 48 and terminating at an inner, annular opening 49. Annular cavity 42 also includes an outer, annular cavity portion 42*b* extending from peripheral, annular opening 48 to an annular, outer opening 50. Inner, annular opening 49 communicates with inner, annular cavity 44; and outer, annular opening 50 communicates with outer, annular cavity 43 as shown in FIG. 3. Electromagnetic energy thus flows between connection means 47 and the plurality of annular slots 32, 33, 34, and 35 by travelling through the intervening cavity portions. In its travel between the plurality of concentric, annular slots 32, 33, 34, and 35 and connection means 47, electromagnetic energy to or from slots 32 and 33 travels through outer, annular cavity 43 and is divided or combined in phase at the outer, annular opening 50. Electromagnetic energy to or from concentric, annular slots 34 and 35 travels through inner, annular cavity 44 and is divided or combined in phase at inner, annular opening 49. The combined energies to or from annular slots 32 and 33 travel through outer, annular cavity portion 42*b* to peripheral, annular opening 48; and the combined energies to or from slots 34 and 35 travel through inner, annular cavity portion 42*a* to peripheral, annular opening 48. The electromagnetic energies to or from slots 32, 33, 34, and 35 are divided, or combined, in phase at peripheral, annular opening 48 and travel through cavity 41 to connection 47. Cavities 41–44 are non-resonant.

As shown in FIG. 3, the antenna connection means may be provided with a plurality of annular power splitters 51, 52, and 53 located, respectively, adjacent peripheral, annular opening 48; inner, annular opening 49; and outer, annular opening 50 to assist the division of electromagnetic energy at openings 48, 49, and 50 within cavities 42, 43, and 44, respectively.

In some embodiments, the height of the lower circular cavity 41 is about one-half wavelength. The height of annular cavity 42 is about one-quarter wavelength; and the height of outer, annular cavity 43 and inner, annular cavity 44 are about one-eighth wavelength. As set forth above, the heights of the inner and outer annular portions of each of annular cavities 42, 43, and 44 may be adjusted to distribute the power among slots 32, 33, 34, and 35 in such a manner that the power density around the periphery of all of the slots is substantially equal. The heights of the respective cavities may be adjusted to achieve other desired power amplitude distributions between and around the annular slots, for example, a distribution to provide low side lobes.

As shown in FIG. 3, connection means 47 comprises a plurality of coaxial connectors located centrally within chamber 41. The plurality of connectors 47*a* and 47*b* comprising connection 47 may be driven in a phase relationship to provide electromagnetic energy at the periphery of slots 32, 33, 34, and 35 which is generally in phase. In addition, connection means 47 may be driven to provide circular polarization to the electromagnetic energy radiated from the antenna and may receive circularly polarized electromagnetic energy.

Figure 4:
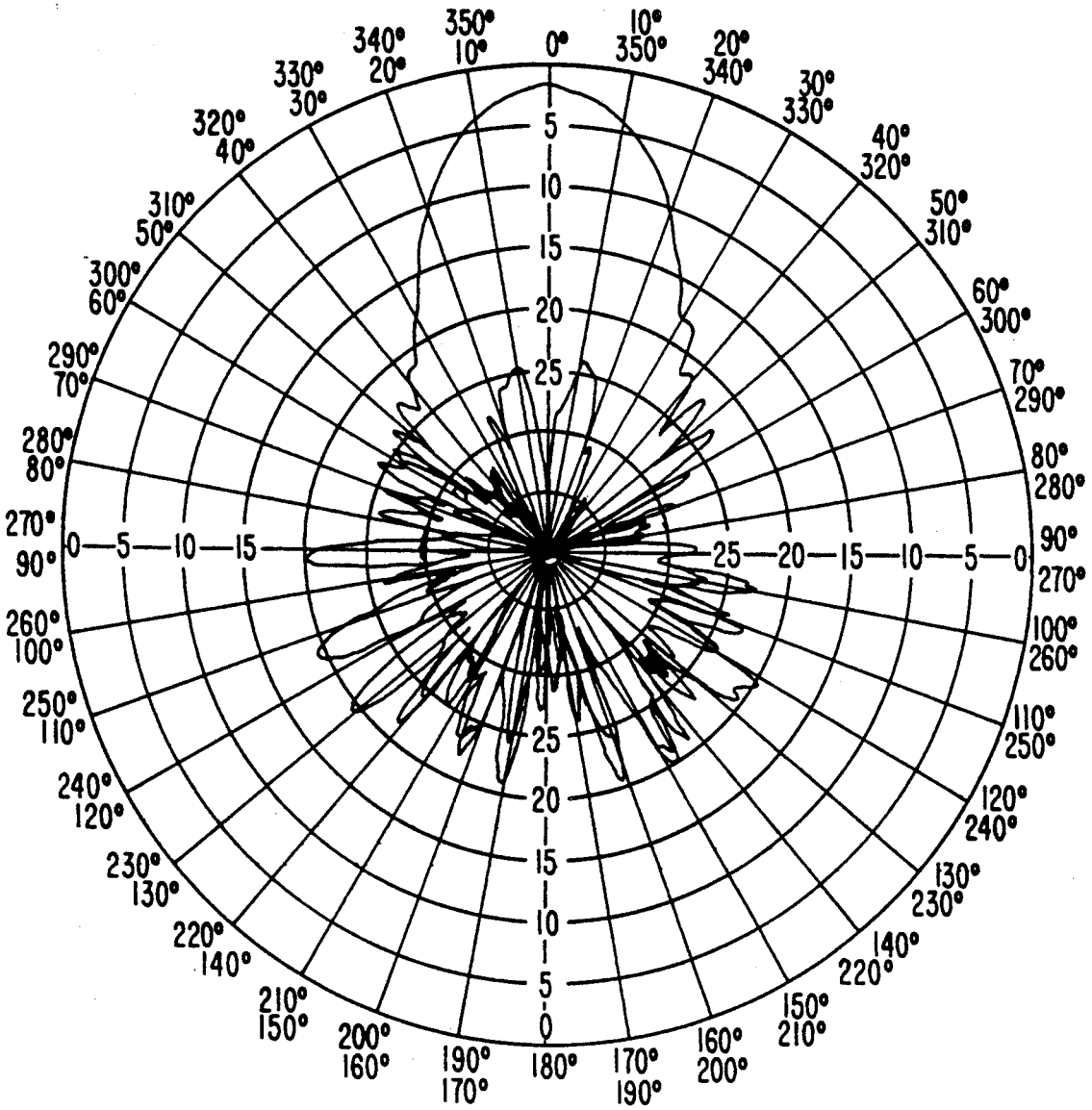
FIG. 4 is an H-plane, linear pattern of the propagation characteristic of the antenna of FIGS. 2 and 3.
Figure 5:
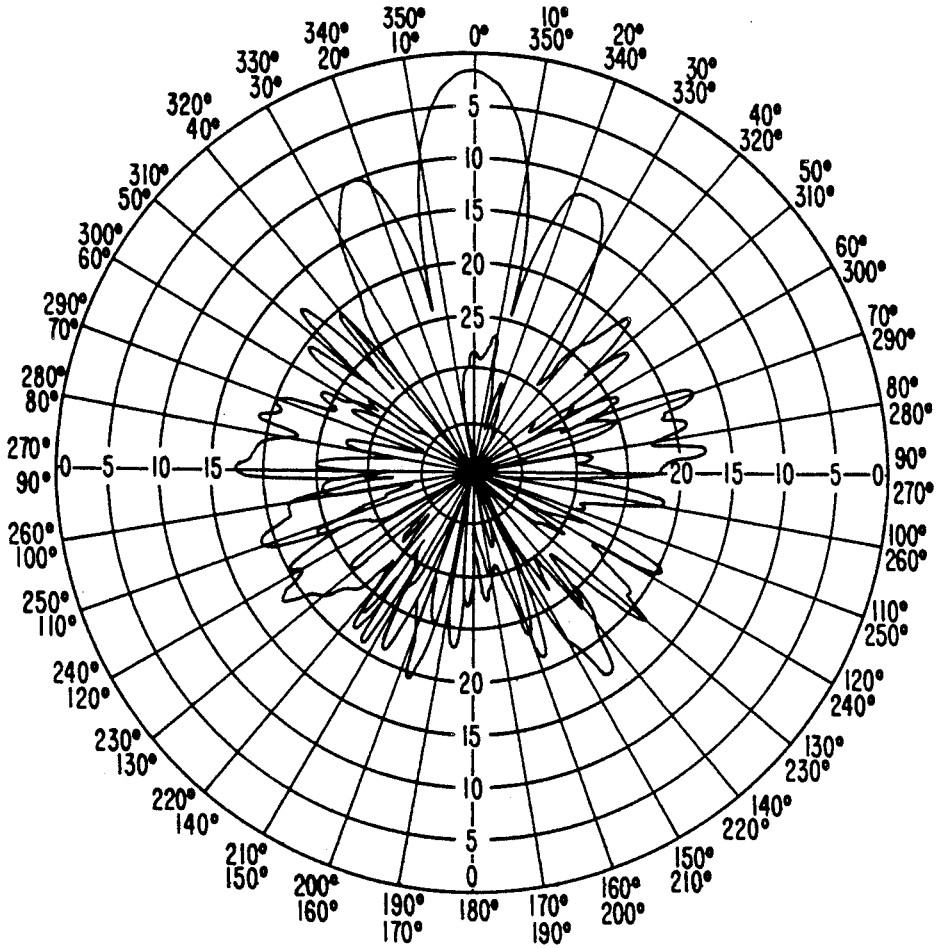
FIG. 5 is an E-plane linear pattern of the propagation characteristic of the antenna of FIGS. 2 and 3.

The antenna of FIGS. 2 and 3 provides an efficient, substantially unidirectional antenna. FIG. 4 shows the H-plane, linear pattern that is typical of the antenna of FIGS. 2 and 3 driven in the TEM mode from connection 47; and FIG. 5 shows the corresponding typical E-plane linear pattern of the antenna As noted from FIGS. 4 and 5, the antenna has substantial unidirectional characteristics. The zero degree axes of FIGS. 4 and 5 corresponds to an axis through the center of the antenna (that is, the central axis of the concentric, annular slots 32, 33, 34, and 35) perpendicular to the plane in which they generally lie.

Figure 6:
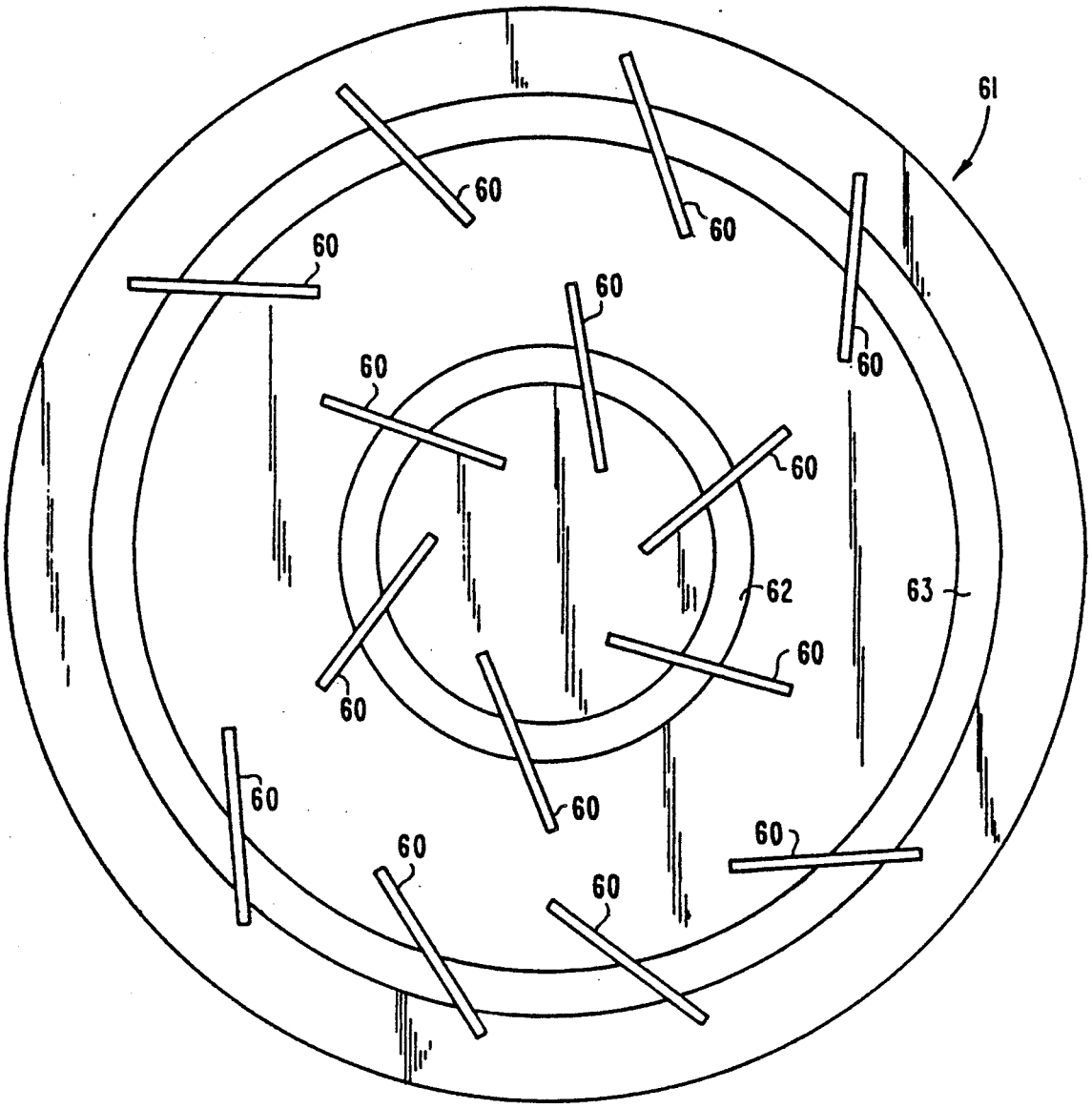
FIG. 6 is an illustration of another antenna of this invention having a plurality of polarizers to suppress cross polarization and enhance the unidirectional propagation of the antenna.
Figure 7:
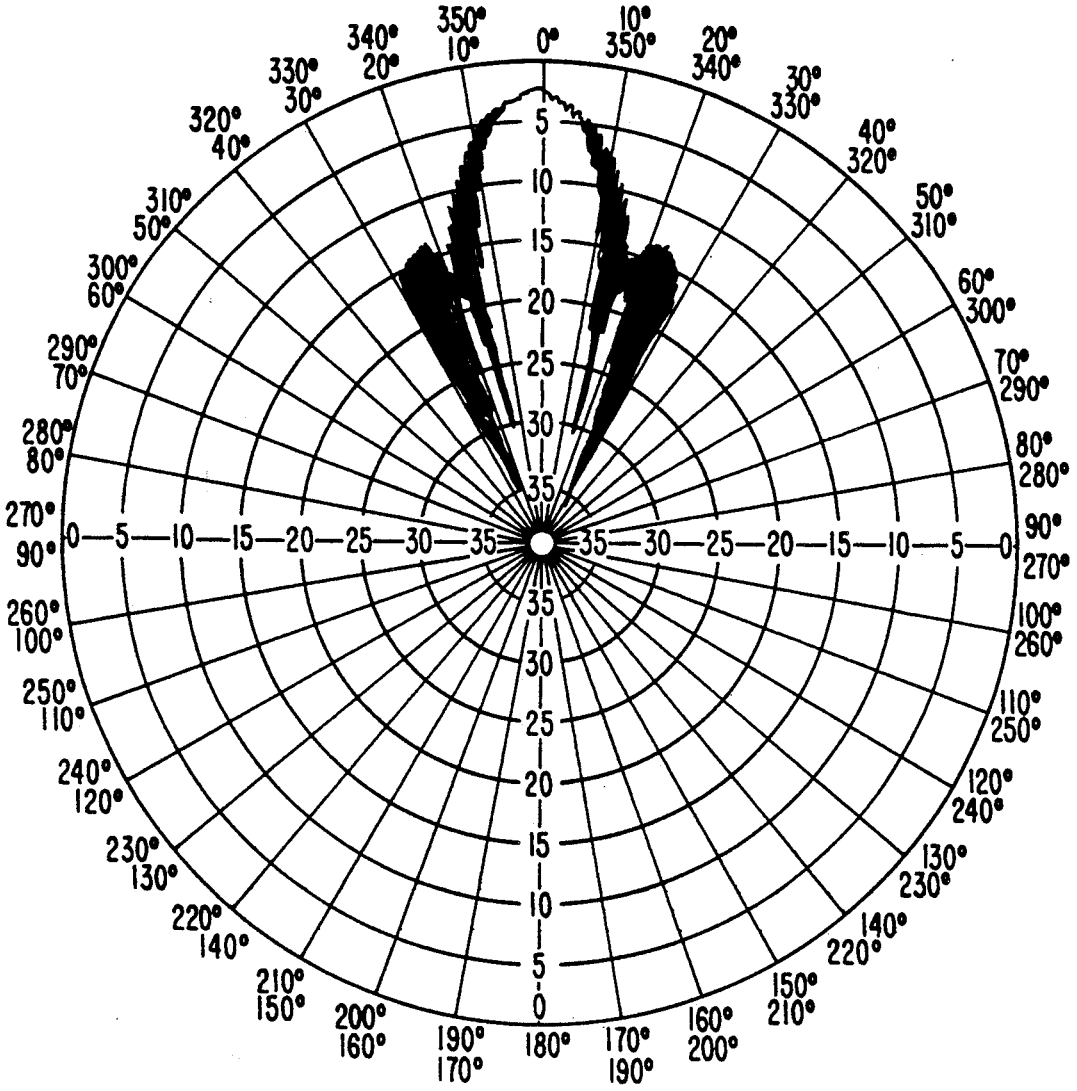
FIG. 7 is a spinning linear pattern of a circular, polarized array of the antenna of FIGS. 2 and 3.

While the antennas shown in FIGS. 1–3 are capable of transmitting electromagnetic energy which is generally in phase at the periphery of each of the plurality of concentric annular slots and are capable of efficiently combining received energy generally in phase within the antenna connection means, it is preferable to provide the antennas with a plurality of antenna elements carried by the slot-forming means adjacent one or more of the plurality of concentric, annular slots to correct for small polarity differences around the periphery of the plurality of annular slots to suppress cross-polarized energy and to enhance the unidirectional sensitivity of the antenna As shown by FIG. 6, the plurality of antenna elements 60 is carried by the slot-forming means 61 in a plurality of locations at least above and over, for example, two concentric, annular slots 62 and 63. The plurality of antenna elements is distributed around the peripheries of the two concentric, annular slots to correct for deviations in polarity of the energy about the periphery of the slots and to suppress cross polarization. Such antenna elements may be short, elongated conductors having a length less than one-half of a wavelength. Such antenna elements may be carried above the slots a distance less than about one-quarter wavelength. As shown in FIG. 6, the antenna elements 60 may be located to lie across the concentric, annular slots 62, 63 at various acute angles to effect correction of the polarization of the electromagnetic energy at those portions of the concentric annular slots.

Antennas of this invention may be inexpensively manufactured by a number of means. For example, the slot-forming means may be formed from inexpensive, printed circuit board material, such as a dielectric substrate, copper clad on both surfaces, which has been photoetched to define a plurality of concentric annular slots on one surface and a plurality of antenna elements on the other surface located to correct polarization of energy from the plurality of concentric, annular slots and to suppress cross polarization and increase the unidirectional sensitivity of the antenna. Such a substrate may or may not be punched to define the slots. The antenna connection means may also be manufactured by microstrip techniques to provide a durable antenna that can be inexpensively manufactured and capable of efficient reception of electromagnetic energy from satellites and other household and commercial applications where expense is a factor.

In addition, the antenna and antenna connection means may be stamped from thin sheet metal, may be cast, or may be metallized molded plastic, or other such inexpensive manufacturing methods. Such manufacturing methods may be used to make a broad band, slot-type antenna with unidirectional sensitivity, comprising slot-forming means defining one or more annular slots and an annular corporate feed for transmitting electromagnetic energy to and from the one or more annular slots.

For example, the antenna of FIG. 1 can be made with a plurality of conductive plates, which may be inexpensive sheet metal such as tinplate. As shown in FIG. 1, such an embodiment of the antenna may include a circular, metallic, ground plane 26 having a base 26*a* and an extension, including portion 11*a* of slot-forming means 11, a terrace 26*b*, and sloping sidewall portions 26*c* and 26*d*. A first circular, metallic plate 27 may be disposed parallel to and spaced from 26*a* of the ground plane to provide peripheral, annular opening 24 as an annular feeding slot between the periphery of first circular plate 27 and the extension portion 11*a*. First circular plate 27 can have a raised section disposed centrally thereon to define portion 11*c* of slot-forming means 11. A second annular, metallic plate 11*b* can be disposed parallel to and spaced from both first circular plate 27 and terrace portion 26*b* of the circular ground plane. The inner peripheral edge of second annular plate 11*b* and raised portion 11*c* of first circular plate 27, as shown in FIG. 1, can provide inner annular slot 13 and the outer peripheral edge of second annular slot 11*b*, and extension 11*a* can provide an outer annular slot 12.

While presently preferred embodiments are shown and described above, it should be apparent to those skilled in the art that other embodiments may be devised without departing from the spirit and scope of the following claims.

We claim:

1. An annular slot antenna, comprising:

means forming at least two concentric, generally coplanar, annular slots, including an outer annular slot and an inner annular slot; and antenna connection means including non-resonant cavity-forming means providing an unobstructed path for interconnecting said at least two concentric, generally coplanar, annular slots with a connection for electromagnetic energy, said cavity-forming means forming a lower, circular cavity, expanding radially from said connection for electromagnetic energy to a peripheral annular opening, and an upper, annular cavity expanding radially outwardly from the peripheral annular opening and terminating at said outer, annular slot and contracting radially inwardly from the peripheral annular opening and terminating at said inner, annular slot, said cavity-forming means being further shaped and dimensioned about the peripheral annular opening to divide electromagnetic energy between the inner, annular slot and the outer, annular slot and to combine generally in phase electromagnetic energy received at said concentric annular slots.

2. The antenna of claim 1 wherein the radial distance between each air of inner and outer, annular slots is between one and one-half wavelengths.

3. The antenna of claim 1 wherein the connection for electromagnetic energy is a waveguide opening at the coaxial center of the lower, circular cavity.

4. The antenna of claim 1 wherein the height of the upper, annular cavity has a different height between the peripheral annular opening and the inner, annular slot than the height between the peripheral annular opening and the outer, annular slot.

5. The antenna of claim 1 wherein the height of the upper, annular cavity between the peripheral annular opening and the inner, annular slot is less than the height of the upper, annular cavity between peripheral annular opening and the outer, annular slot.

6. The antenna of claim 1 wherein said antenna connection means is adapted to transmit electromagnetic energy with circular polarization.

7. An annular slot antenna, comprising:

means forming at least two concentric, generally coplanar, annular slots, including an outer annular slot and an inner annular slot; and antenna connection means including non-resonant cavity-forming means providing an unobstructed path interconnecting said at least two concentric, generally coplanar, annular slots with a connection for electromagnetic energy, said cavity-forming means forming a lower, circular cavity, having a height of one-half wavelength and expanding radially from said connection for electromagnetic energy to a peripheral annular opening, and an upper, annular cavity, having a height of one-quarter wavelength and expanding radially outwardly from the peripheral annular opening and terminating at said outer, annular slot and contracting radially inwardly from the peripheral annular opening and terminating at said inner, annular slot, said cavity-forming means being further shaped and dimensioned about the peripheral annular opening to divide electromagnetic energy between the inner, annular slot and the outer, annular slot and to combine generally in phase electromagnetic energy received at said concentric annular slots.

8. An annular slot antenna, comprising:

means forming at least two concentric, generally coplanar, annular slots, including an outer annular slot and an inner annular slot; and antenna connection means including non-resonant cavity-forming means providing an unobstructed path interconnecting said at least two concentric, generally coplanar, annular slots with a connection for electromagnetic energy comprising a plurality of phased stub tuners, said cavity-forming means forming a lower, circular cavity, expanding radially from said plurality of phased stub tuners located centrally therein to a peripheral annular opening, and an upper, annular cavity expanding radially outwardly from the peripheral annular opening and terminating at said outer, annular slot and contracting radially inwardly from the peripheral annular opening and terminating at said inner, annular slot, said cavity-forming means being further shaped and dimensioned about the peripheral annular opening to divide electromagnetic energy between the inner, annular slot and the outer, annular slot and to combine generally in phase electromagnetic energy received at said concentric annular slots.

9. The antenna of claim 8 wherein the plurality of phased stub tuners includes four phased stub tuners.

10. An annular slot antenna, comprising:

means forming at least two concentric, generally coplanar, annular slots, including an outer annular slot and an inner annular slot; and antenna connection means including non-resonant cavity-forming means interconnecting said at least two concentric annular slots with a connection for electromagnetic energy, said cavity-forming means forming a lower circular cavity, expanding radially from said connection for electromagnetic energy to a peripheral annular opening, and an upper annular cavity expanding radially outwardly from said peripheral annular opening and terminating at said outer annular slot and contracting radially inwardly from the peripheral annular opening and terminating at said inner annular slot, said slot-forming means carrying an annular power divider located within the upper annular cavity adjacent the peripheral annular opening, said cavity-forming means being further shaped and dimensioned about the peripheral annular opening to divide electromagnetic energy between the inner annular slot and the outer annular slot and to combine generally in phase electromagnetic energy received at said at least two concentric annular slots.

11. An annular slots antenna, comprising:

means forming at least two concentric, generally coplanar, annular slots, including an outer annular slot and an inner annular slot; and antenna connection means including non-resonant cavity-forming means providing an unobstructed path interconnecting said at least two concentric, generally coplanar, annular slots with a connection for electromagnetic energy, said cavity-forming means forming a lower, circular cavity, expanding radially from said connection for electromagnetic energy to a peripheral annular opening, and an upper, annular cavity expanding radially outwardly from the peripheral annular opening and terminating at said outer, annular slot and contracting radially inwardly from the peripheral annular opening and terminating at said inner, annular slot, said cavity-forming means being further shaped and dimensioned about the peripheral annular opening to divide electromagnetic energy between the inner, annular slot and the outer, annular slot and to combine generally in phase electromagnetic energy received at said concentric annular slots, said means forming at least two concentric, generally coplanar, annular slots carrying a plurality of antenna elements located over the inner, annular slot and over the outer, annular slot to provide uniform polarization of electromagnetic energy to and from the slots.

12. The antenna of claim 11 wherein each of the antenna elements of said plurality of antenna elements is a small elongated conductor having a length less than one-half of the wavelength of the central frequency of the antenna bandwidth.

13. The antenna of claim 12 wherein said antenna elements are carried by the means forming at least two concentric, generally coplanar, annular slots in locations to enhance the unidirectional sensitivity of the antenna.

14. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means defining a plurality of radially extending cavities providing unobstructed paths adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots; and plurality of antenna elements carried by said slot-forming means over and above one or more of said substantially concentric, annular slots to enhance the unidirectional sensitivity of said antenna.

15. The antenna of claim 14 wherein said plurality of antenna elements is carried by said slot-forming means in a plurality of locations spaced over and above said one or more annular slots and distributed around their peripheries to suppress cross polarization to and from said antenna.

16. The antenna of claim 15 wherein the antenna elements of said plurality of antenna elements are each elongated conductors having a length less than one-half of the wavelength of the frequency at the center of the operating bandwidth of the antenna.

17. The antenna of claim 16 wherein the antenna elements are spaced above the plane of the one or more slots a distance less than about one-quarter of a wavelength of said frequency.

18. The antenna of claim 14 wherein the frequency bandwidth is one octave or more.

19. The antenna of claim 14 wherein the cavities of the antenna connection means are non-resonant at the desired frequencies of operation.

20. The antenna of claim 14 wherein the plurality of cavities and unobstructed paths of said antenna connection means include at least one interconnection providing uniform electromagnetic power density at the plurality of substantially concentric, annular slots by unequal power division at the interconnection of the plurality of cavities.

21. The antenna of claim 14 wherein the plurality of substantially concentric annular slots includes two slots, the outermost of said two concentric, annular slots communicates with an outer, annular cavity portion, the innermost of said two concentric, annular slots communicates with an inner, annular cavity portion, and said inner, annular cavity portion and outer, annular cavity portion merge at a peripheral annular opening of a lower, circular cavity, said inner and outer, annular cavity portions and said lower, circular cavity portion comprising said plurality of radially extending cavities formed by said antenna connection means.

22. The antenna of claim 21 wherein said inner annular cavity portion has a different height than said outer, annular cavity portion.

23. The antenna of claim 14 wherein said antenna connection means operates in the TEM mode.

24. The antenna of claim 14 wherein said antenna connection means is adapted to send and receive electromagnetic energy to said plurality of concentric, annular slots with circular polarization.

25. The antenna of claim 14 wherein each of the antenna elements of said plurality of antenna elements lies across one or more of the plurality of concentric, annular slots at an acute angle.

26. The antenna of claim 14 wherein each of the plurality of concentric, annular slots is spaced from adjacent concentric, annular slots by one-half wavelength of the frequency of the center of the antenna-operating frequencies.

27. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means defining a plurality of interconnected radially extending cavities with power splitters positioned between said radially extending cavities to assist combination of electromagnetic energy received at said plurality of concentric annular slots substantially in phase and division of electromagnetic energy between said concentric, annular slots for transmission from said slots generally in phase along a central axis perpendicular to the plane of the plurality of annular slots; and a plurality of antenna elements carried by said slot-forming means adjacent one or more of said substantially concentric, annular slots to enhance the unidirectional sensitivity of said antenna.

28. A broadband, slot-type antenna with unidirectional sensitivity, comprising:

slot-forming means defining at least two substantially concentric and coplanar, annular slots, including at least an innermost and an outermost concentric, annular slot;

antenna connection means for transmitting electromagnetic energy to and from at least the innermost and outermost concentric, annular slots, said antenna connection means defining a plurality of radially extending cavities, including a lower circular cavity, an outer annular cavity portion and an inner annular cavity portion, the outermost of said at least two concentric, annular slots communicating with said outer, annular cavity portion, the innermost of said at least two concentric, annular slots communicating with said inner, annular cavity portion, and said inner, annular cavity portion and said outer, annular cavity portion merging at a peripheral annular opening of the lower, circular cavity;

a power splitter carried within said antenna connection means between said inner annular cavity portion and said outer annular cavity portion;

said antenna connection means being adapted to combine electromagnetic energy received at said innermost and outermost concentric annular slots substantially in phase and to divide electromagnetic energy between said innermost and outermost concentric, annular slots for transmission from said innermost and outermost annular slots generally in phase along a central axis perpendicular to the plane of said innermost and outermost annular slots; and a plurality of antenna elements carried by said slot-forming means adjacent one or more of said at least two substantially concentric, annular slots to enhance the unidirectional sensitivity of said antenna.

29. The antenna of claim 28 wherein said power splitter is carried by said slot-forming means.

30. The antenna of claim 28 wherein said power splitter is located over said peripheral annular opening.

31. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means defining a plurality of radially extending cavities adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots; and a plurality of antenna elements carried by said slot-forming means adjacent one or more of said substantially concentric, annular slots to enhance the unidirectional sensitivity of said antenna, said slot-forming means and said plurality of antenna elements being formed on one or more conductor-clad dielectric substrates by microstrip manufacturing methods.

32. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means defining a plurality of radially extending cavities adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots; and a plurality of antenna elements carried by said slot-forming means adjacent one or more of said substantially concentric, annular slots to enhance the unidirectional sensitivity of said antenna, said antenna connection means being formed by one or more conductor-clad dielectric substrates and microstrip manufacturing methods.

33. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means comprising conductor means defining a plurality of interconnected radially extending cavities and forming an unobstructed path adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots.

34. The antenna of claim 33 wherein the cavities defined by the conductor means are non-resonant at the desired frequencies of operation.

35. The antenna of claim 34 wherein the slot-forming means and antenna connection means have dimensions providing a frequency bandwidth of one octave or more.

36. The antenna of claim 33 wherein the plurality of cavities and unobstructed path defined by said conductor means include at least one interconnection providing uniform electromagnetic power density around the peripheries of the plurality of substantially concentric, annular slots by unequal power division at the interconnection of the plurality of cavities.

37. The antenna of claim 35 wherein portions of said radially extending cavities have different heights.

38. The antenna of claim 33 wherein said antenna connection means is adapted to operate in the TEM mode.

39. The antenna of claim 33 wherein said antenna connection means is adapted to send and receive electromagnetic energy to said plurality of concentric, annular slots with circular polarization.

40. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means comprising conductor means defining a plurality of interconnected radially extending cavities and forming an unobstructed path including power splitters positioned in said path between said radially extending cavities to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots.

41. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said slot-forming means and said antenna connection means comprising one or more conductor clad dielectric substrates formed by microstrip manufacturing methods and defining a plurality of radially extending cavities adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots.

42. A broadband, slot-type antenna with unidirectional sensitivity, comprising:

slot-forming means defining a plurality of substantially concentric and coplanar, annular slots;

antenna connection means for transmitting electromagnetic energy to and from the plurality of concentric, annular slots, said antenna connection means being formed by one or more conductor-clad dielectric substrates and microstrip manufacturing methods to define a plurality of radially extending cavities adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots.

43. A broadband, slot-type antenna with unidirectional sensitivity, comprising:

slot-forming means defining a plurality of substantially concentric and coplanar, annular slots, the distance between each adjacent pair of the plurality of annular slots being determined by the formula:

$$d = \frac{1 - \frac{1}{2n}}{1 + \sin\theta} \cdot \lambda$$

where n equals the number of annular slots, $\theta$ equals the beam angle from broadside, and $\lambda$ equals the wavelength at the center of the operating bandwidth of the antenna;

antenna connection means for transmitting electromagnetic energy to and from the plurality of concentric, annular slots, said antenna connection means comprising conductor means defining a plurality of interconnected radially extending cavities and forming an unobstructed path adapted to combine electromagnetic energy received at said plurality of concentric annular slots substantially in phase and to divide electromagnetic energy between said concentric, annular slots for transmission from said slots generally in phase along a central axis perpendicular to the plane of the plurality of annular slots.

44. An antenna, comprising:

a circular ground plane having a base and an extension connected thereto including a terrace attached to said base by a sidewall;

a first circular plate disposed parallel to and spaced from the base to provide a feeding slot between the periphery of said first circular plate and said extension, said first circular plate having a raised section disposed centrally thereon; and a second annular plate having inner and outer peripheral edges, second annular plate being disposed parallel to and spaced from the first circular plate and terrace to provide an inner annular slot between the raised section of the first circular plate and the inner peripheral edge of the second annular plate and an outer annular slot between the outer peripheral edge of said second annular plate and the extension of the circular ground plane.

45. An antenna as recited in claim 44 wherein the sidewall of the extension is sloping.

46. An antenna as recited in claim 44 wherein the first circular plate is disposed above the base by about one-half wavelength and the second circular plate is disposed above the first circular plate by about one-quarter wavelength.

47. An antenna as recited in claim 44 wherein the first and second annular slots are spaced apart a distance greater than one-half wavelength.

48. An antenna as recited in claim 44 wherein the height from the base to the first circular plate is about twice the height from the first circular plate to the second annular plate.

49. An antenna as recited in claim 44 wherein said antenna includes a feeding means connected to base and located centrally thereon.

50. An antenna as recited in claim 49 wherein the feeding means is a waveguide.

51. An antenna as recited in claim 49 wherein the feeding means is a transmission line.

52. The antenna of claim 44 wherein said ground plane, first circular plate, and second annular plate are formed by stamping thin sheet metal.

53. An antenna, comprising:

a circular ground plane having a base and an extension connected thereto including a terrace attached to said base by a sidewall;

a first circular plate disposed parallel to and spaced from the base to provide a feeding slot between the periphery of said first circular plate and said extension, said first circular plate having a raised section disposed centrally thereon; and a second annular plate having inner and outer peripheral edges, said second annular plate being disposed parallel to and spaced from the first circular plate and terrace to provide an inner annular slot between the raised section of the first circular plate and the inner peripheral edge of the second annular plate and an outer annular slot between the outer peripheral edge of said second annular plate and the extension of the circular ground plane, said second annular plate being provided with a power divider positioned above the feeding slot.

54. An antenna, comprising:

a circular ground plane having a base and an extension connected thereto including a terrace attached to said base by a sidewall;

a first circular plate disposed parallel to and spaced from the base to provide a feeding slot between the periphery of said first circular plate and said extension, said first circular plate having a raised section disposed centrally thereon;

a second annular plate having inner and outer peripheral edges, said second annular plate being disposed parallel to and spaced from the first circular plate and terrace to provide an inner annular slot between the raised section of the first circular plate and the inner peripheral edge of the second annular plate and an outer annular slot between the outer peripheral edge of said second annular plate and the extension of the circular ground plane; and polarization means comprising a plurality of dipoles positioned across and spaced above said annular slots and electrically coupled to said second annular plate.

* * * * *